United States Patent [19]

Kessler et al.

[11] Patent Number: 4,957,224

[45] Date of Patent: Sep. 18, 1990

[54] MULTI-SPOUTED SERVING PITCHER

[75] Inventors: William Kessler, Sheboygan; Gerald J. Champeau, Manitowoc, both of Wis.

[73] Assignee: The Vollrath Company, Inc., Sheboygan, Wis.

[21] Appl. No.: 407,724

[22] Filed: Sep. 14, 1989

Related U.S. Application Data

[63] Continuation of Ser. No. 192,489, May 11, 1988, abandoned.

[51] Int. Cl.[5] ..... A47G 19/14

[52] U.S. Cl. ..... 222/465.1; 222/478; 222/572; D7/315; D7/318

[58] Field of Search ..... 222/478, 480, 465.1, 222/475.1, 572, 566; D7/312, 315, 316, 318, 319, 300-303

[56] References Cited

U.S. PATENT DOCUMENTS

| | | | |
|---|---|---|---|
| 148,045 | 3/1874 | Gates | 222/566 |
| D. 219,045 | 10/1970 | Benes | D7/319 |
| D. 266,450 | 10/1982 | Swett et al. | D7/319 |
| 1,710,951 | 4/1929 | Shaweker | 222/572 |
| 1,718,897 | 6/1929 | Dunbar et al. | 222/572 |
| 1,841,664 | 1/1932 | Montalbano | 222/566 |
| 1,873,624 | 8/1932 | Moxey | 222/465.1 |
| 2,815,155 | 12/1957 | Roche | 222/572 |
| 2,982,450 | 5/1961 | Whitton | 222/572 |
| 2,990,981 | 7/1961 | Schmitt et al. | 222/572 |
| 3,063,602 | 11/1962 | Anderson | 222/480 |
| 3,405,849 | 10/1968 | Kellogg | 222/572 |

FOREIGN PATENT DOCUMENTS

| | | | |
|---|---|---|---|
| 2114133 | 7/1972 | Fed. Rep. of Germany | 222/572 |
| 794518 | 2/1936 | France | 222/572 |
| 218509 | 7/1924 | United Kingdom | 222/572 |

*Primary Examiner*—H. Grant Skaggs
*Attorney, Agent, or Firm*—Foley & Lardner

[57] ABSTRACT

A multi-spouted serving pitcher construction is disclosed for facilitating spill-resistant retention and delivery of potable liquid. The disclosed open top pitcher includes an angled spill guard which retains splashing or sloshing liquid against spilling. The pitcher also includes at least one auxiliary spout defined in the spill guard. These and other features provide a multi-spouted open top serving pitcher particularly desirable for holding and serving potable liquid in a spill-resistant sanitary manner.

13 Claims, 2 Drawing Sheets

10
28
30
32
34
36
38
40
42
46
25
24
18
44

MULTI-SPOUTED SERVING PITCHER

This application is a continuation of U.S. Pat. application Ser. No. 192,489, filed on May 11, 1988, now abandoned.

FIELD OF THE INVENTION

This invention relates to a serving pitcher having a multi-spouted open top and spill guard features.

BACKGROUND OF THE INVENTION

Potable liquids, such as water, milk and assorted other beverages, are commonly served from pitchers, jugs, mugs, steins and the like. Open-top spouted pitcher constructions are generally preferred. An open top pitcher has no lid or cover to interfere with filling the pitcher with liquid or with cleaning. Spouted pitchers typically have a projecting pouring spout that directs the delivery of the liquid from the pitcher. A lipless spout is an outlet, such as a notch or cut out opening, that provides in effect a spout having no projecting lip features typically associated with projecting spouts.

Frequently potable liquids must be carried or moved for some distance for service, especially in commercial establishments, restaurants and institutional kitchens. During such transport, splashing or sloshing of the liquid contents in the pitcher occurs resulting in undesirable and unsanitary spillage.

Until now, spillage of liquid from an open-top pitcher could be overcome only by resorting to covering the pitcher. However, covers and lids are less convenient and less sanitary than open-top pitchers. The lids must be removed or lifted for filling the pitcher, and for serving the contents of the pitcher. Consequently, such lids and covers are usually hinged and harder to sanitize, thereby presenting crevices where germs or soil can accumulate.

Another problem is that most potable liquids are usually iced with cubed or chipped ice, sometimes fruited as with sliced fruits or even foamed. Consequently, spout guards restricting all or some delivery of ice, fruit, foam or the like are sometimes desirable, necessary or both.

Where iced liquid is desired, lids and covers interfere. Some past attempts have been made to provide lids having selective openings that provide a choice between free flowing delivery of both ice and liquid, or ice-free delivery. For ice-free service, openings incorporate ice guards that restrict ice flow. Some of these lid designs are also rotatable for open and closed positions. However, none of these lid constructions overcome the inconvenience and sanitation problems discussed above.

Thus open-top pitchers continue to be generally preferred. In some open-top pitchers, ice guards have been incorporated in the lips of projecting pouring spouts to restrict ice flow. However, this type of ice lip construction limits the usefulness of the pitcher. As a result, where iced liquid is desired, the server must serve it from such a pitcher by pouring liquid from the side of the pitcher. This type of service results in a generally non-directional, uncontrolled flow of liquid and much undesirable spillage.

Some past attempts have been made to overcome this problem by providing multiple spouts in open-top pitchers. In these past designs, one spout incorporates an ice guard while a side spout extends outwardly for the rest of the pitcher. While these multi-spouted pitchers give the server a choice of delivering iced or ice-free liquid, they do not overcome the spilling problems associated with open top pitchers. In fact, the outwardly projecting side spout increases the amount of spillage.

Thus, considerable attention has been given in the past to the design of a variety of spout and handle designs for open-top pitchers used for serving potable liquid. In spite of this, however, none of the prior open-top pitcher constructions overcomes the problem of spillage. Such spillage is typically induced when an open-top pitcher is carried, moved or tilted slightly in transit and service.

There is a need, therefore, for a open-top serving pitcher that incorporates the spill-resistent benefit of a covered pitcher without the accompanying inconvenience and sanitation problems. An ideal pitcher would also offer the benefits of a multi-spouted pitcher in giving the server a choice of ice-free or iced liquid delivery. To resolve the difficulties discussed above, this invention provides such a pitcher.

SUMMARY OF THE INVENTION

A spill-resistant and open-top pitcher construction is disclosed having spill guard features and multiple spouts. The multi-spouted pitcher of this invention, facilitates retaining and delivering of potable liquid, especially iced liquid, in a spill-resistant and sanitary manner.

Briefly described, the spill-resistant pitcher of this invention comprises a container defining a chamber capable of retaining liquid, a projecting pouring spout, a spill guard means and at least one auxiliary spout defined in the spill guard means.

Specifically, the container comprises a shell body having a base at one end, and a substantially vertical shell wall having an open upper edge at the opposite end. One portion of the upper edge of the shell wall is shaped to define a projecting pouring spout. For this purpose the shell wall is preferably extended outwardly from the remainder of the shell body and generally angled downwardly from the plane of the remaining spoutless portion of the upper edge.

A spill guard means of this invention is secured to the perimeter of the upper edge of the shell wall. This spill guard means is generally angled inwardly so that the rim of the spill guard means defines an open top end for the pitcher. The defined open top end has an opening of a lesser diameter than that defined by the upper edge of the shell wall. By being so angled, the spill guard means, in effect, retains splashing or sloshing liquid against spilling when the pitcher is carried, moved or tilted in a manner normally causing splashing or spillage.

The pitcher also includes at least one auxiliary spout that is in fluid communication with the chamber. The auxiliary spout is defined by a notch in the rim of the spill guard means and positioned in generally transverse relationship to the projecting pouring spout. Preferably, the notch is configured to provide a lipless pouring spout. A particularly preferred embodiment has two generally opposing auxiliary spouts defined in the spill guard means.

In a preferred embodiment, the pouring spout includes a spout guard means defined by a cooperating portion of the spill guard means having an aperture configured for placing the spout in fluid communication with the chamber. In another aspect, the multi-spouted pitcher of this invention includes a hand grip means such as a handle, disposed on the exterior of the shell body generally opposite the projecting pouring spout. A particularly preferred embodiment includes auxiliary hand grip means in the form of a plurality of raised generally vertical ribs disposed on the exterior surface of the shell body.

These and other features provide a multi-spouted spill-resistant serving pitcher. One major benefit is that the spill guard feature of a pitcher of this invention retains the desirable convenience of an open-top and the spill-free advantage of a cover without the associated undesirable disadvantages. Another benefit is that a pitcher of this invention provides the advantages of multiple-spouted pitchers in offering the server a choice of free flowing iced liquid or restricted ice-free liquid delivery.

Yet another benefit is that auxiliary spouts defined in the spill guard means of this invention provide for substantially spill-resistant delivery from either right-handed or left-handed pouring service. Still another benefit against spillage is provided by the auxiliary hand grip means in giving the server an additional non-skid hold on the wet container. Thus, a pitcher of this invention is particularly desirable for holding, carrying and serving potable liquid in a sanitary, spill-resistant manner.

Numerous other features and advantages of the present invention will become readily apparent from the following detailed description of the invention, the accompanying drawings and the appended claims.

DETAILED DESCRIPTION OF A PREFERRED EMBODIMENT

Figure 2:
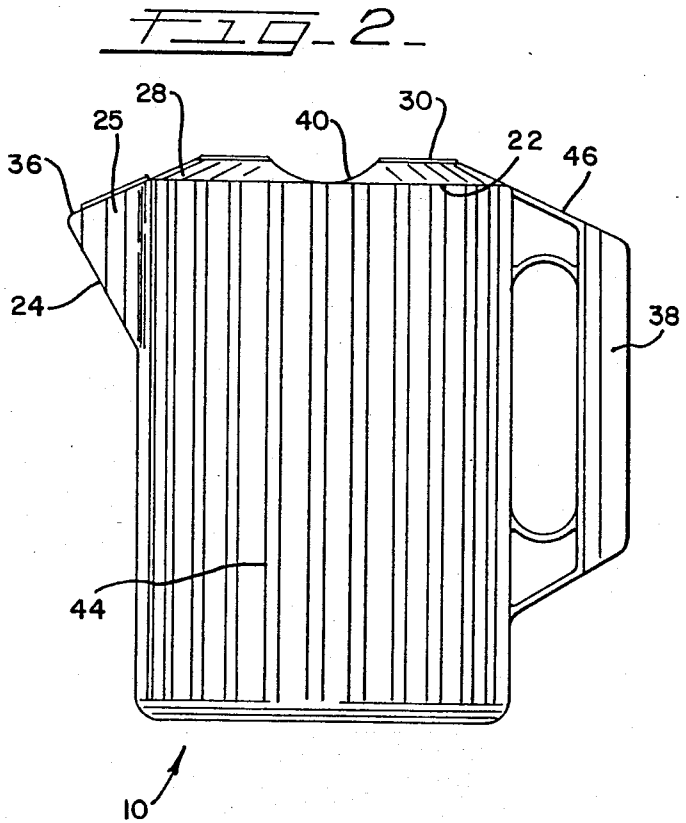
FIG. 2 is a side elevational view of the embodiment seen in FIG. 1 showing the relationship of one of the auxiliary spouts to the projecting spout.

While this invention is susceptible of embodiment in many different forms, there is shown in the drawings one specific preferred embodiment which will be described in detail. It is understood however, that the present disclosure is intended to exemplify principles of the invention and is not intended to limit the invention to the embodiment illustrated.

Figure 1:
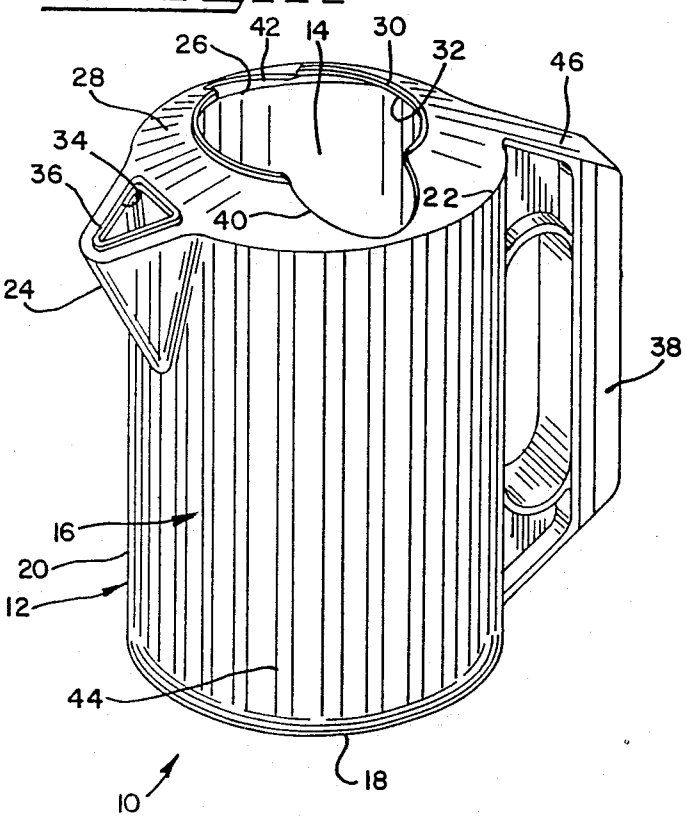
FIG. 1 is a perspective view of a preferred embodiment of a multi-spouted open-top pitcher of this invention.

Referring to FIG. 1, a front perspective view is shown of a multi-spouted pitcher 10 of this invention illustrated with all its preferred features in position for hand-holdable service. The pitcher 10 comprises a generally circular container 12 defining a chamber 14. The container 12 has a shell body 16 that has one substantially flat support base end 18 as can best be seen in FIG. 6, and a substantially vertical shell wall 20. The shell wall 20 has an open upper edge 22.

Figures 3, 4, 5, 6:
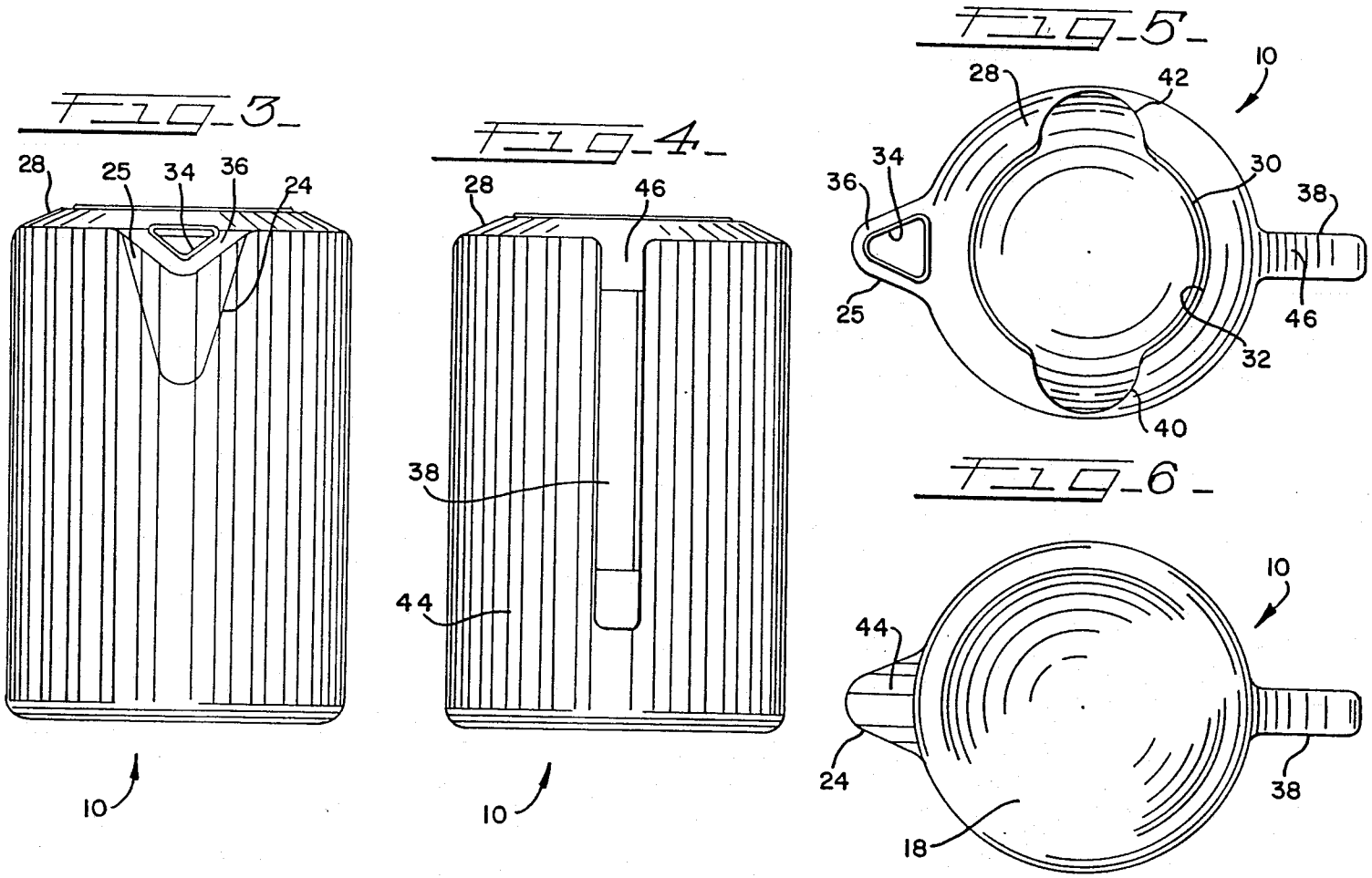
FIG. 3 is a front elevational view showing the spout guard means formed by the cooperation of the spill guard means and the pouring spout of the embodiment seen in FIG. 1.
FIG. 4 is a rear elevational view of the hand grip means of the embodiment seen in FIG. 1.
FIG. 5 is a top elevational view of the spill guard means of the preferred embodiment seen in FIG. 1.
FIG. 6 is a view of the base end of the preferred embodiment seen in FIG. 1.

As illustrated in FIGS. 1, 2 and 3, one portion of the upper edge 22 of the shell wall 20 is extended outwardly from the shell body 16 and is generally angled downwardly from the plane of the upper edge 22 to form the lips 25 of a projecting pouring spout 24.

The angle of projecting pouring spout 24 is preferably about 30 degrees outwardly from the vertical plane of the shell wall 20 and about 25 degrees downwardly from the plane of the upper edge 22. However, the shape and angle of the projecting pouring spout is not limited and can be varied. The length and depth of the portion of the upper edge 22 of the shell body 16 selected for forming a projecting spout generally determines the size of the remaining spoutless portion 26.

For example the portion of the upper edge 22 selected provides a projecting pouring spout having a cross width of about 2 inches (about 5 centimeters) at its widest point and a depth of about 2 inches (about 5 centimeters) for a pitcher having an overall height of about 8 inches (about 20 centimeters). In another aspect, the depth of the projecting spout can be formed having a shallower width and longer depth by forming the container in a non-circular shape as for example, an oval, an oblong or a rectangular shape, or by incorporating a vertical indent down the full length of the shell body of the container. Thus the configuration of the spout and the container can be selected as desired for purposes of this invention.

As seen in FIGS. 1–5, a spill guard means 28 having a rim 30 embodying the principles of this invention is secured to the perimeter of the upper edge 22. As constructed in this embodiment, the spill guard means 28 is generally angled inwardly from the shell wall 20. Thus, while the rim 30 of the spill guard means 28 defines an open top end having an opening 32, the width of the spill guard means provides, in effect, a semi-cover for the pitcher.

In this preferred embodiment the rim 30 defines the generally circular opening 32, prior to notching, of lesser diameter than that defined by the upper edge 22 of the shell wall 20, as seen in FIGS. 1 and 5. The shape of the opening 32 can be varied as desired and is generally determined by the configuration of the container 12. The radius of the opening 32 is preferably large enough to permit access for filling and cleaning purposes, yet small enough to provide sufficient width for the spill guard means 28 to serve its intended spill prevention. Generally, an opening of a spill guard width of about 0.8 inches (about 2 centimeters) and about 3.75 inches (about 9.4 centimeters) is preferred for a 2½ quart (0.9 liter) pitcher.

The spill guard means 28 includes at least one auxiliary spout 40 defined by a notch in the rim 30 in fluid communication with the chamber 14. In the preferred embodiment illustrated, as seen in FIGS. 1, 2 and especially in FIG. 5, the spill guard means 28 has a second auxiliary spout 42 positioned generally opposing the first auxiliary spout 40.

The auxiliary spouts 40 and 42 are each positioned generally transverse to the projecting spout 24. By positioning the two auxiliary spouts 40 or 42, each generally transverse to the projecting spout, the server has the option of either right handed or left handed service. As desired, each of the auxiliary spouts can be the same or different in configuration.

For convenience, the configuration of each notch 40 and 42 illustrated is the same and substantially semicircular. The size of the notch 40, 42 illustrated can be varied, but is preferably wide enough to permit iced liquid delivery. As illustrated in FIGS. 1, 2 and 5, a suitable auxiliary spout 40, 42 is formed by a notch having a radius substantially the same as the width of the spill guard means 28.

Preferably, the auxiliary spout is lipless to permit unrestricted iced liquid delivery. Additionally, by forming the auxiliary spouts in the form of lipless spouts, the multi-spouted pitchers of this invention can be stored side by side.

Where serving pitchers, especially those of several quarts or greater capacity, are constructed of relatively lightweight plastic material, the upper edge of the open mouth area of the pitcher tends to deform and weaken. This problem is overcome by the pitcher of this invention by the angled spill guard means 28 which provides support for the upper edge 22.

As seen in FIGS. 1, 3 and 5 a portion of the spill guard means 28 adjacent the upper edge 22 cooperates with the projecting pouring spout 24, to place it in fluid communication with the chamber 14. For this purpose, the spill guard means 28 includes an aperture 34 configured such to provide a spout guard means 36 for the projecting pouring spout 24. Alternatively, the rim 30 may extend to the projecting spout 24 such that the opening 32 continues on into the projection of spout 24.

The shape of the resulting spout guard means 36 can be varied by the shape and size of the aperture 34. Preferably, the spout guard means 36 is shaped for restricting ice flow and for providing some added support to the projecting pouring spout 24, as can be seen in FIGS. 1, 3 and 5. In the preferred embodiment illustrated, the spout guard means 36 and the projecting spout 24 are preferably integrally formed. The spill guard means 28 has, in effect, a continuous forward extension generally tapered outwardly to substantially the same degree as the projecting pouring spout 24.

The spill guard means 28 of this invention is preferably integrally formed with the container as by blow molding. Alternatively, the spill guard means may be molded separately and snapped-onto the upper edge of the container.

The pitcher 10 illustrated also has a hand grip means in the form of a handle 38 mounted on the container 12 generally opposite the projecting pouring spout 24 as seen in FIGS. 1, 2, 5 and 6. In this embodiment, the upper portion of the handle 38 is mounted such that a portion of the spill guard means 28 adjacent the upper edge 22 cooperates with the handle 28 as can be seen in FIGS. 1, 4 and 5. By this cooperation, the spill guard means 28 includes a continuous rearward extension to provide a thumbhold 46 that tapers outwardly to substantially the same degree as the portion of the handle 38 mounted at the upper edge 22 of the container 12.

In one aspect, the inward angle of the spill guard means 28 will determine the taper of both the thumbhold 46 of the handle 38 and the spout guard means 36 by its cooperation therewith.

A pitcher of this invention can be constructed as by molding without the handle 38, if desired, where the overall dimension of the pitcher is relatively small. However, typically for commercial and institutional service, a pitcher of about 2½ quart (0.9 liter) capacity is generally preferred. Thus, a relatively sturdy handle is usually required for support.

The size and shape of the handle 38 can be varied. Preferably, the length should be sufficient for the server to grasp it comfortably and should be mounted to extend outwardly enough to permit the fingers to encircle the handle. The handle 38 should be sturdy enough to support the weight of a pitcher when full. For this purpose, therefore, the lower portion of the handle 38 as illustrated is preferably also mounted to the container 12 rather than freely projecting.

A problem usually encountered in handling wet pitchers during cleaning, storage or serving is that smooth exterior container surfaces become slippery. Thus, the container can slip out of the server's grasp where a handle is not used or is absent. To overcome this problem, the circumference of the container 12 of the preferred embodiment also has auxiliary hand grip means disposed on the exterior surface of the shell wall 20.

As seen in FIGS. 1–4, the auxiliary hand grips can be provided by a plurality of raised spaced apart vertical ribs 44 (one indicated). The spacing of the ribs 44 is preferably such that the server can comfortably grip the surface with the hand or fingers. A suitable spacing for the ribs 44 can be about 0.22 to about 0.40 inches (about 0.55 to about 1 centimeter), preferably about 0.25 to about 0.375 inches (about 0.625 to about 0.938 centimeters).

A multi-spouted pitcher embodying the principles of this invention can be any overall dimension desired. However, for a particularly preferred useful embodiment having three spouts, and a circular container of the type shown in FIGS. 1–6 having a 2½ quart capacity (0.9 liter), a preferred overall height is about 8 to about 8.5 inches (about 20 to about 21.25 centimeters), and a preferred outer diameter is about 5 to about 5.5 inches (about 12.5 to about 13.75 centimeters) at the base end. A preferred shell body has a shell wall thickness of about 0.05 to about 0.100 inches, (about 0.125 and about 0.25 centimeters) preferably about 0.07 to about 0.09 inches (about 0.175 to about 0.225 centimeters).

A pitcher of this invention can be constructed by generally known manufacturing operations, such as blow molding, injection molding, casting, extrusion, drawing and the like. Blow molding is particularly preferred.

For example, when the pitcher body and spill guard means of the preferred embodiment discussed above and illustrated in FIGS. 1–6 is blow molded, the handle is preferably blown as a hollow core handle by means of a blow needle from the bottom of the handle. The open top end and the two auxiliary spouts are machined in the spill guard means with fly cutters after the pitcher has been molded. To form the spout guard means, a dome is molded over the projecting pouring spout when the pitcher body is being molded. This dome is then machined off with the aperture on the underside of the dome.

Particularly suitable materials for constructing a pitcher of this invention are nontoxic to humans, relatively rigid and easily sanitized. Such materials preferably comply with the regulations of the Food Additives Amendment of 1958 to the Federal Food, Drug and Cosmetic Act as suitable for use with potable food products. Exemplary materials that are sanitizable include glass, synthetic resin plastic, aluminum, stainless steel and the like.

Particularly preferred is a moldable plastic material, particularly one suited for blow molding operations. Exemplary materials are polymeric plastics, such as polypropylene, polyethylene, polyvinyl chloride, polyethylene terephthalate (PET), acrylic plastic and the like. Polypropylene is particularly preferred for blow molding a pitcher of this invention.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An apparatus adaptable for retention and delivery of a liquid, the apparatus comprising:

a substantially planar base;

at least one wall;

a spill guard means for resisting spilling of said liquid; and a handle;

said at least one wall terminating in an upper terminus and cooperating with said base to form a unitary liquid-retentive well; said well being substantially symmetrically disposed about a first axial plane and a second axial plane; said first axial plane being substantially perpendicular with said second axial plane;

said at least one wall lobularly deviating to provide an integral first spout, said first spout being substantially symmetrical about said first axial plane and depending outwardly from said well;

said handle depending from said at least one wall outwardly from said well; said handle being substantially symmetrical about said first axial plane;

said spill guard means comprising a skirt depending inwardly over said well from said upper terminus and terminating in an inner terminus; said inner terminus presenting a first lobe and a second lobe; said first lobe and said second lobe being substantially symmetrically disposed about said second axial plane; said spill guard means further comprising communication access means for facilitating flow of said liquid from said first spout.

2. An apparatus adaptable for retention and delivery of a liquid as recited in claim 1 wherein said inner terminus is substantially symmetrically disposed about said first axial plane and said second axial plane.

3. An apparatus adaptable for retention and delivery of a liquid as recited in claim 2 wherein said apparatus is integrally formed.

4. An apparatus adaptable for retention and delivery of a liquid as recited in claim 2 wherein said at least one wall comprises one wall.

5. An apparatus adaptable for retention and delivery of a liquid as recited in claim 2 wherein the apparatus is generally polygonal in sectional planes parallel with said base.

6. An apparatus adaptable for retention and delivery of a liquid as recited in claim 1 wherein said base and said at least one wall are integrally formed.

7. An apparatus adaptable for retention and delivery of a liquid as recited in claim 1 wherein said apparatus is integrally formed.

8. An apparatus adaptable for retention and delivery of a liquid as recited in claim 1 wherein said at least one wall comprises one wall.

9. An apparatus adaptable for retention and delivery of a liquid as recited in claim 8 wherein said base and said at least one wall are integrally formed.

10. An apparatus adaptable for retention and delivery of a liquid as recited in claim 8 wherein said apparatus is integrally formed.

11. An apparatus adaptable for retention and delivery of a liquid as recited in claim 1 wherein the apparatus is generally polygonal in sectional planes parallel with said base.

12. An apparatus adaptable for retention and delivery of a liquid as recited in claim 11 wherein said base and said at least one wall are integrally formed.

13. An apparatus adaptable for retention and delivery of a liquid as recited in claim 11 wherein said apparatus is integrally formed.

* * * * *